United States Patent [19]

Feuchter et al.

[11] Patent Number: 4,703,616

[45] Date of Patent: Nov. 3, 1987

[54] BEARING AND DRIVE FOR A HORIZONTALLY ARRANGED OPEN-END SPINNING ROTOR

[75] Inventors: Wolfgang Feuchter, Deggingen-Reichenbach; Dieter Goetz, Geislingen/Steige; Friedbert Schmid, Bad Ueberkingen, all of Fed. Rep. of Germany

[73] Assignees: Fritz Stahlecker; Hans Stahlecker, both of Fed. Rep. of Germany

[21] Appl. No.: 909,945

[22] Filed: Sep. 22, 1986

[30] Foreign Application Priority Data

Sep. 21, 1985 [DE] Fed. Rep. of Germany ..... 3533717

[51] Int. Cl.[4] ..... D01H 1/241; D01H 1/135; D01H 7/22

[52] U.S. Cl. ..... 57/105; 57/88; 57/92; 57/406

[58] Field of Search ..... 57/78, 88, 89, 104, 57/105, 92, 406, 407

[56] References Cited

U.S. PATENT DOCUMENTS

| | | | |
|---|---|---|---|
| 3,868,815 | 3/1975 | Stahlecker | 57/88 |
| 4,051,654 | 10/1977 | Bartling | 57/406 |
| 4,058,966 | 11/1977 | Raasch | 57/104 X |
| 4,070,814 | 1/1978 | Goldammer et al. | 57/105 X |
| 4,183,199 | 1/1980 | Schumann | 57/105 X |
| 4,184,315 | 1/1980 | Braun et al. | 57/105 X |

FOREIGN PATENT DOCUMENTS

| | | |
|---|---|---|
| 1901453 | 8/1970 | Fed. Rep. of Germany . |
| 2141276 | 3/1973 | Fed. Rep. of Germany . |
| 2525435 | 10/1976 | Fed. Rep. of Germany . |
| 3324129 | 1/1985 | Fed. Rep. of Germany . |
| 3346843 | 7/1985 | Fed. Rep. of Germany . |

*Primary Examiner*—John Petrakes
*Attorney, Agent, or Firm*—Barnes & Thornburg

[57] ABSTRACT

A bearing and driving assembly is disclosed for an open and spinning rotor unit of a spinning unit of the type having a rotor mounted on a rotor shaft, a twin disk bearing arrangement for rotatably supporting the rotor shaft and a tangential belt drivingly engaging the rotor shaft. A tension roller is loaded against the tangential belt. To minimize failures of such a system caused by a resonant system vibrations and to facilitate high spinning speeds with minimal manufacturing expenses, the supporting disk pairs are axially spaced a distance slightly larger than the axial width of the tension roller. Brake members are disposed below the tangential belt so as to be applied with substantially horizontal movement radially against the rotor shaft.

19 Claims, 3 Drawing Figures

36
52
54
34
35
15
26
27
25
24
29
28
14
30
31
52
B
13
32
33
12
c
c
1
2
4
3
47
18
42
6
19
39
40
8
59
58
57
A
56
55
II
P
51
49
48
50

BEARING AND DRIVE FOR A HORIZONTALLY ARRANGED OPEN-END SPINNING ROTOR

BACKGROUND AND SUMMARY OF THE INVENTION

This invention relates to a bearing and drive for a horizontally arranged open-end spinning rotor unit that has a rotor and a rotor shaft that is disposed in wedge-shaped gaps of two pairs of supporting disks axially spaced from one another along the rotor shaft. The rotor shaft is driven by a moving tangential belt which engages the rotor shaft between the pairs of supporting disks. The tangential belt is loaded in the direction of the wedge-shaped gap by a tension roller arranged between the pairs of supporting disks in proximity of the rotor shaft. The tension roller can be lifted off the tangential belt via an actuating member for interrupting the drive, and also for making it possible to apply a braking member to the rotor shaft.

Bearings and drives of the above noted type are disclosed in German Pat. (DE-PS) No. 19 01 453 and German Published Examined Application (DE-AS) No. 21 41 276 which are suitable for use with rotor speeds up to about 80,000 revolutions per minute. This type of bearing and the pertaining drive is a very complex vibration system because the supporting disks are equipped with a spring-like elastic fittings and also because the tangential belt, via the tension roller, is elastically pressed against the rotor shaft. In addition, accumulations of fiber material and/or direct within the spinning rotor occur eccentrically with respect to the rotor shaft. By means of a construction, especially a stronger construction of the rotor shaft of the open-end spinning rotor, it is provided that the operating speed is sufficiently below the critical rotational speed (rotational speed inducing harmful resonant harmonic vibrations) of the system. In such a case, the critical speed is only relatively difficult to determine and may also possibly change during operation by fiber material accumulation with the spinning rotor.

Currently, in the rotor spinning industry speeds of more than 100,000 min $-1$ revolutions per minute are preferred, which further increases the problem of the critical speed. In order to solve this problem and especially to avoid a stronger dimensioning of the rotor-shaft, which would require a stronger dimensioning of the supporting disks and bearings resulting in an increased power consumption, it is disclosed in German published patent application (DE-OS) No. 33 24 129 and corresponding pending U.S. patent application Ser. No. 627,559, filed July 3, 1984, now U.S. Pat. No. 4,667,464, to develop the system in such a way that the operating speed of the open-end spinning rotor is above the critical speed. In this construction, difficulties may occur because at the starting time, the first critical speed located at a relatively low speed is passed through rapidly, whereas the second higher critical speed is not passed as rapidly so that vibration problems may occur.

It is an object of the present invention to provide a bearing and a drive arrangement of the type mentioned above which will facilitate operation with rotational speeds of more than 100,000 revolutions per minute, below a critical speed, without resulting in an increased expenditure of material and without disproportionately increased power consumption.

This objective is achieved by providing a braking member which has at least two brake shoes that can be applied to the rotor shaft essentially radially and essentially horizontally from the direction of two sides and which is arranged below the tangential belt. Further, the supporting disk pairs are arranged at a clear distance (axial spacing of respective axially facing surfaces of the disks of the disk pairs) from one another that corresponds to the axial width of the tension roller plus a tolerance play.

In a preferred embodiment of the invention the clear distance between the supporting disk pairs is minimized, thereby moving the critical speed into a range of significantly higher speeds, without the necessity of strengthening the rotor shaft and/or the bearings of the supporting disks. With the decrease of the distance between the supporting disk pairs, it is also possible to reduce the length of the shaft of the open-end spinning rotor so that weight and power may also be saved at increased speeds.

A bearing and a drive for an open-end spinning rotor has been disclosed in German Published patent application (DE-AS) No. 25 25 435, in which the rotor shaft is disposed in wedged-shaped gaps of supporting disk pairs and is driven by a tangential belt moving between the supporting disks. Further, braking means are arranged below the tangential belt. These braking means include brake shoes that are applied from below to the shaft of the open-end spinning rotor which lift the rotor shaft out of the wedge-shaped gap and press it against two slide bearings. In this construction, a tension roller loading the tangential belt is provided which is located at a distance from the rotor shaft and is arranged outside the range of the supporting disk pairs. As a result, space is created for a lifter pulley that can be applied to the tangential belt from below when the rotor shaft is lifted out. This pulley lifts the tangential belt off the rotor shaft during the stopping operation, because otherwise the belt would run against the rotorshaft that is lifted out of the wedge-shaped gap with increased pressure force. In this construction, the supporting disk pairs in the axial direction of the rotor shaft are arranged at a relatively large distance from one another in the axial direction of the rotor shaft in order to create a space in which the actuating means for the braking device are guided. In this construction, it is a disadvantage that the rotor shaft leaves the wedge-shaped gap because this results in increased stress to the supporting disk pairs during the starting as well as during the stopping operation. In addition, the arrangement of the tension roller is disadvantageous because the introduction of the driving force into the rotor shaft is impaired.

In another type of bearing disclosed in German Published Unexamined application (DE-OS) No. 33 46 843), the rotor shaft is disposed in the proximity of the spinning rotor with one pair of supporting disks. At the end of the shaft that faces away from the rotor the shaft is provided with a bearing that receives axial and radial forces and a braking device having two brake shoes. The braking device in this construction is arranged laterally staggered with respect to the tangential belt driving the rotor shaft in the proximity of the pair of supporting disks. The brake shoes are arranged on two arms that project over the rotor shaft and the tangential belt in upward direction. The brake shoes are applied in one direction radially to the rotor shaft and radially to the respective opposite supporting disks so that the rotor shaft is pressed into the wedge-shaped gap. When transferring such a braking device to a bearing with two pairs of supporting disks, the clear distance between the pairs of supporting disks would necessarily be increased by the braking device. In the case of such a transfer, it would also be necessary to provide two braking devices of this type on both sides of the tangential belt because it cannot be arranged in the center between the pairs of supporting disks.

In a further development of certain preferred embodiments of the invention, it is provided that the brake shoes are arranged on tong arms that can be pivoted around a pivot shaft arranged essentially vertically under the rotor shaft and extending in parallel to it. As a result, it is possible to apply the break shoes approximately horizontally to the rotor shaft from both sides. In an advantageous development of the invention, it is provided in this case that the brake shoes are provided with cup-shaped braking surfaces adapted to the rotor shaft. This ensures that the brake shoes grip the rotor shaft securely without pressing it with increased force against the linings of the supporting disks.

In a further development of certain preferred embodiments of the invention, it is provided that the actuating mechanism for the lifting-off of the tension roller is connected with the actuating mechanism for the actuating of the braking device via a springy intermediate element. As a result, despite having a joint actuating device, the lifting-off of the tension roller is functionally separate from the application of the braking device, so that the tension roller is always lifted off the tangential belt the same amount, even when the brake shoes become worn.

In the case of a practical construction of a preferred embodiment of the invention, it was found that the critical speed can be shifted sufficiently far into the range of high speeds, even when the operational speed reaches about 120,000 revolutions per minute, when the clear distance between the supporting disk pairs is no more than 1.8 times the width of the tangential belt. In the case of customary machine lengths and therefore the required power requirement for the drive of about 100 spinning rotors of one side of the machine, it has proven to be advantageous because of the dimensions of the tangential belt that the clear distance between the disks of the supporting disk pairs is no more than 45 mm.

In a further development of preferred embodiments of the invention, it is provided that the spinning rotor has a rotor shaft of a length of no more than 90 mm and a diameter of at least 7.5 mm and a rotor of a weight of no more than 0.7 N (Newtons which converts to 0.157367 pound weight). When the supporting disk pairs are arranged at a suitable distance, the result is an advantageous relationship for the bearing expenditures and for the required driving power while avoiding the critical speed.

Further objects, features, and advantages of the present invention will become more apparent from the following description when taken with the accompanying drawings which show, for purposes of illustration only, an embodiment constructed in accordance with the present invention.

DETAILED DESCRIPTION OF THE DRAWINGS

Figure 1:
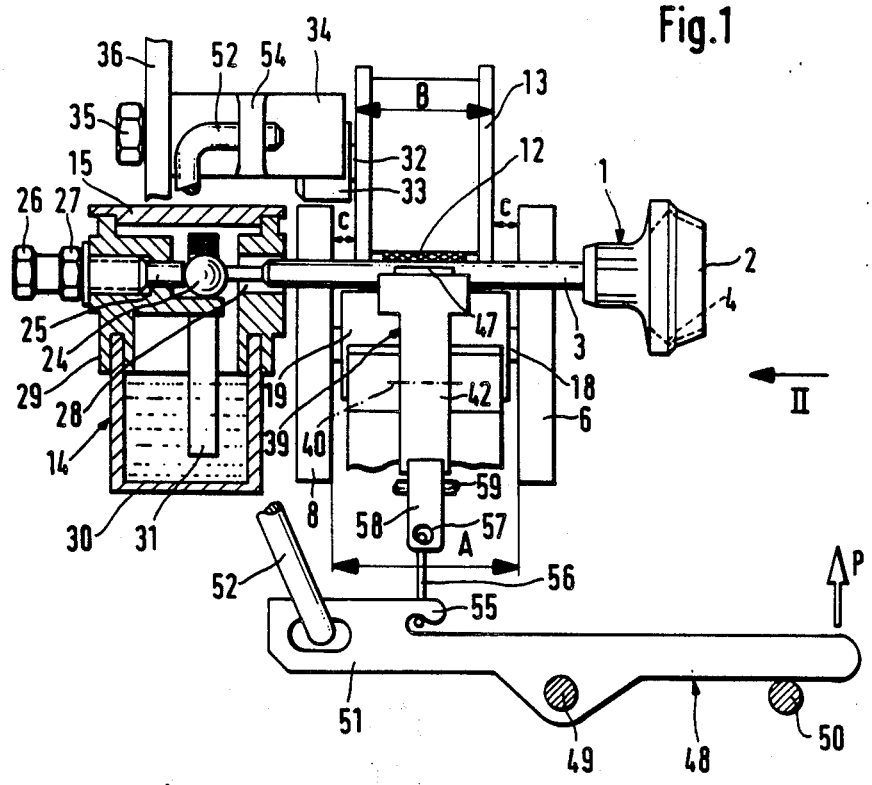
FIG. 1 is a side schematic view of a spinning rotor bearing and drive arrangement constructed in accordance with a preferred embodiment of the present invention, with a cross-sectional view of a bearing arrangement, having certain components not shown for clarity.

In the drawings and the following description, like reference characters are used throughout the various views to designate like structures.

In order not to obscure the present invention, the drawings and the following descriptions only include those parts of a rotor spinning machine as are deemed necessary for one skilled in the art to practice the invention. For example, it will be understood by one skilled in the art of rotor spinning that a complete rotor spinning machine would include a plurality of spinning units arranged adjacent one another and each having a spinninq rotor and bearing assembly with certain common driving elements such as the tangential belt described below.

The open-end spinning rotor unit shown has a rotor 2 and a rotor shaft 3 torsionally fixed together. The open-end spinning rotor unit is arranged so that the rotor shaft 3 extends essentially horizontally and transversely to the longitudinal direction of a spinning machine, and so that the rotor 2 points to the operating side of the machine with its open side. On the inside of the rotor 2 there is a fiber sliding surface that expands conically into a fiber collecting groove 4 which defines the nominal diameter of the open-end spinning rotor unit 1. Due to the desired high speeds, this nominal diameter is preferably 33 mm or less. The total weight of the rotor is preferably no more than 0.7 N (Newtons).

The essentially horizontally aligned rotor shaft 3, in radial direction, is disposed in wedge-shaped gaps 5 of two pairs of supporting disks 6, 8 and 7, 9. Each of the supporting disks 6, 8 and 7, 9 has a basic body that is made preferably of aluminum and is coated with a plastic coating 11 serving as the running surface for the rotor shaft 3.

The rotor shaft 3 is supported in the axial direction by a step bearing 14 located on the side facing away from the rotor 2. During operation, the rotor shaft 3 is loaded with an axial force in the direction of the step bearing 14 that is preferably generated as an axial push, for example, by means of the fact that the shafts 18 of the supporting disks 6, 8 and 7, 9 are disposed offset with respect to one another by a small angular amount. An end of the rotor shaft is reduced in its cross-section and supports itself against a ball bearing 24 contained in step bearing 14. On the side that is opposite the rotor shaft 3, the step ball bearing 24 is supported by means of a bolt 25 so that by means of the vibrations occurring during the operation and because of the rotations of the rotor rotor shaft 3, the step ball bearing 24 is driven to perform irregular rotational movements. On the step ball bearing 24 is located a wick 31 that dips into a lubricant bath of a housing 30 and supplies the step ball bearing 24 with lubricant. The step ball bearing 24 is located in a step bearing housing 29 into which the bolt 25 is screwed. The bolt 25 is equipped with a screwhead 26 and is secured by a check nut 27. On the side facing the rotor shaft 3, the step bearing housing 29 is equipped with a passage opening 28 for the end of the rotor shaft 3. Sealing means (not shown) are arranged in the passage opening 28 which preferably cause a sealing with respect to the rotor shaft without contact.

Figure 3:
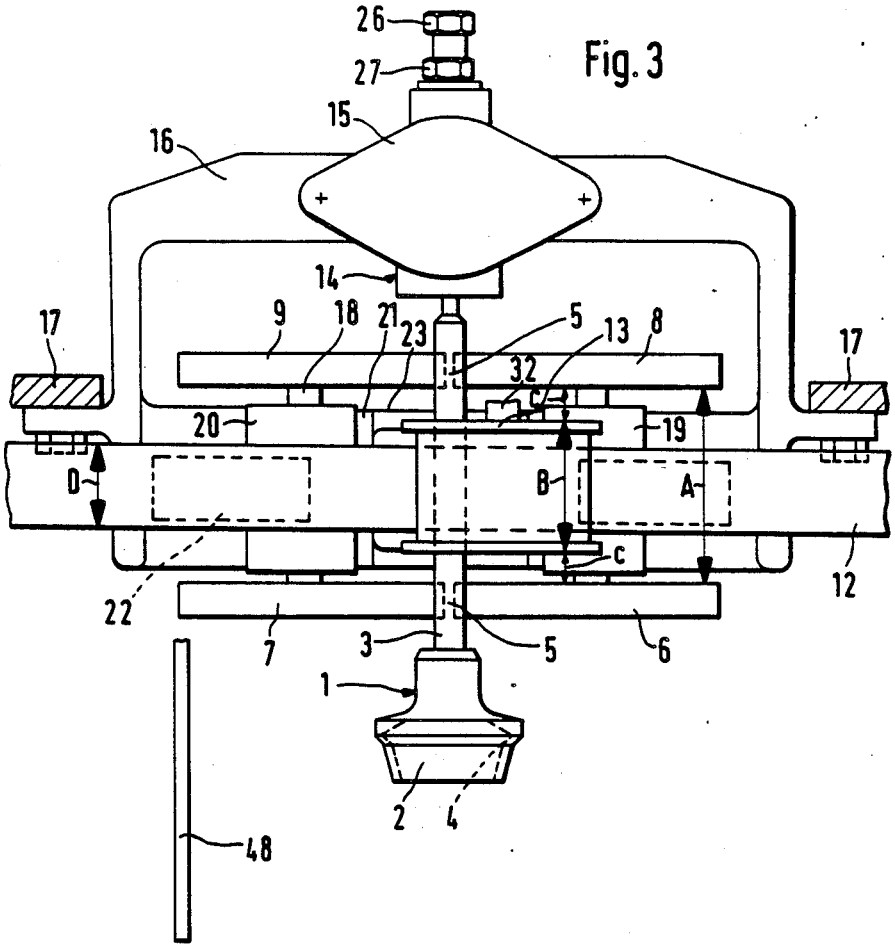
FIG. 3 is a top schematic view of the embodiment according to FIGS. 1 and 2, having certain components not shown for clarity.

The step bearing housing 29 is equipped with an upper covering 15 which is fastened by means of a flange, at a frame support assembly 16. The frame assembly 16 forms bearing blocks that receive the bearing housings 19 and 20 of the two shafts 18 of the supporting disks 6, 8 and 7, 9. This frame assembly bearing block 16 contains half-shell-shaped bearing receiving members 21 for the bearing housing 19 and 20 of the shafts 18 that are help clamped into the bearing receiving members 21 by means of leaf springs 22. Between the two bearing receiving members 21, the bearing block 16 has two webs 23 that leave a space in the center area. The bearing block 16 is equipped with lateral tongues by means of which, via screws, it is fastened at a part 17 of the machine frame (FIG. 3).

The drive of the rotor shaft 3 takes place via a tangential belt 12 that moves in the center between the two supporting disk pairs 6, 8 and 7, 9. The tangential belt 12 runs against the rotor shaft 3 from above so that it holds the rotor shaft in the wedge-shaped gaps 5 of the supporting disk pairs 6, 8 and 7, 9. The tangential belt 12 is loaded against the rotor shaft 3 and the wedge-shaped gaps 5 by a tension roller 13 that in the longitudinal direction of the tangential belt 12 is arranged close to the rotor shaft 3 and is thus located in the area between the supporting disk pairs 6, 8 and 7, 9. In the operating position, the tension roller 13 presses the tangential belt 12 against the rotor shaft 3 of the open-end spinning rotor unit 1 with a sufficient force which slightly deflects the tangential belt 12 so that it lightly winds around the small part of the circumference of rotor shaft 3. The tension roller 13 is equipped with collars on both sides for guiding the tangential belt 12. In addition, the circumferential surface of the tension roller 13 moving against the tangential belt 12 in its axial direction is wider than the tangential belt 12 in order to ensure sufficient play to prevent damage at the lateral edges of the tangential belt 12, especially in the case of high belt speeds. The tension roller 13 is located on a shaft 32, extending at least approximately in parallel to the rotor shaft 3, which is disposed in a bearing 33 that is held in a double-armed lever 34 that can be pivoted around a stationary shaft 35. The stationary shaft 35 is essentially parallel to the rotor shaft 3 and is mounted at the machine frame in a way that is not shown in detail. The lever 34 is loaded by a loading spring 37 so that the tension roller 13 is elastically pressed against the tangential belt 12. The force of the loading spring 37 is selected in such a way that the tangential belt 12 in the operating position is pressed against the rotor shaft 3 of the open-end spinning rotor 1 with a force of about 25 N. The loading spring 37 is constructed as a leaf spring, the end which faces away from the lever 34 being preferably adjustably mounted at a part 38 of the machine frame.

The arm 54 of the lever 34 facing away from the tension roller 13 is coupled to a transmission rod 52 via a joint 53. The transmission rod 52 is connected with a two-armed actuating lever 48 extending essentially in parallel to the rotor shaft 3. The actuating lever 48 is accessible from the operating side of the spinning arrangement. The arm 51 of the two-armed actuating lever 48, to which the transmission rod 52 projecting into the spinning arrangement is coupled, can be pivoted around a stationary shaft 49 extending essentially transversely to the rotor shaft 3, and thus in longitudinal direction of a spinning machine. The spinning unit operating position of the actuating lever 48 is fixed against the effect of the loading spring 37 by means of a stop 50. The stop 50 is preferably adjustable. By means of an actuating of the actuating lever 48 in the direction of the Arrow P, the tension roller 13 can be lifted off the tangential belt 12.

In order to be able to stop the spinning rotor 1, a braking device 39 is provided. The braking device is arranged below the tengential belt 12. The tangential belt 12 move in the center between the two supporting disk pairs 6, 8 and 7, 9. The braking device 39 is also arranged in the center between the pairs of supporting disks 6, 8 and 7, 9 in the area between the webs 23 of the bearing block 16 of the bearings 19 and 20 of the shafts 18. The braking device 39 has two brake shoes 46 and 47 arranged below the tangential belt 12, that can be applied to the rotor shaft 3 approximately radially and horizontally. The two brake shoes 46 and 47 that have cup-type braking surfaces adapted to the diameter of the rotor shaft 3, are held by tong arms 41 and 42 are developed as double-armed levers. The arms facing away from the brake shoes 46 and 47 are connected with one another via a spring 45 that pulls these two arms together, and as a result, holds the brake shoes 46 and 47 in the opened position. The spring 45 is developed as a bent leaf spring having ends which are connected with the tong arms 41 and 42. Via joints 43 and 44 an actuating element 60 is applied to the convex exterior side of the bent leaf spring 45. The actuating element 60 can be moved toward the joint pivotal shaft 40 of the two tong arms 41, 42. By means of the movement of the actuating element 60 in the direction of the pivotal shaft 40, the ends of the tong arms 41 and 42 that face away from the brake shoes 46 and 47 are spread apart so that the brake shoes 46 and 47 are applied to the rotor shaft 3. In the case of this braking operation, the rotor shaft 3 remains in its position in the wedge-shaped gaps 5 of the supporting disk pairs 6, 8 and 7, 9 so that the supporting disks 6, 8 and 7, 9 are also braked.

Figure 2:
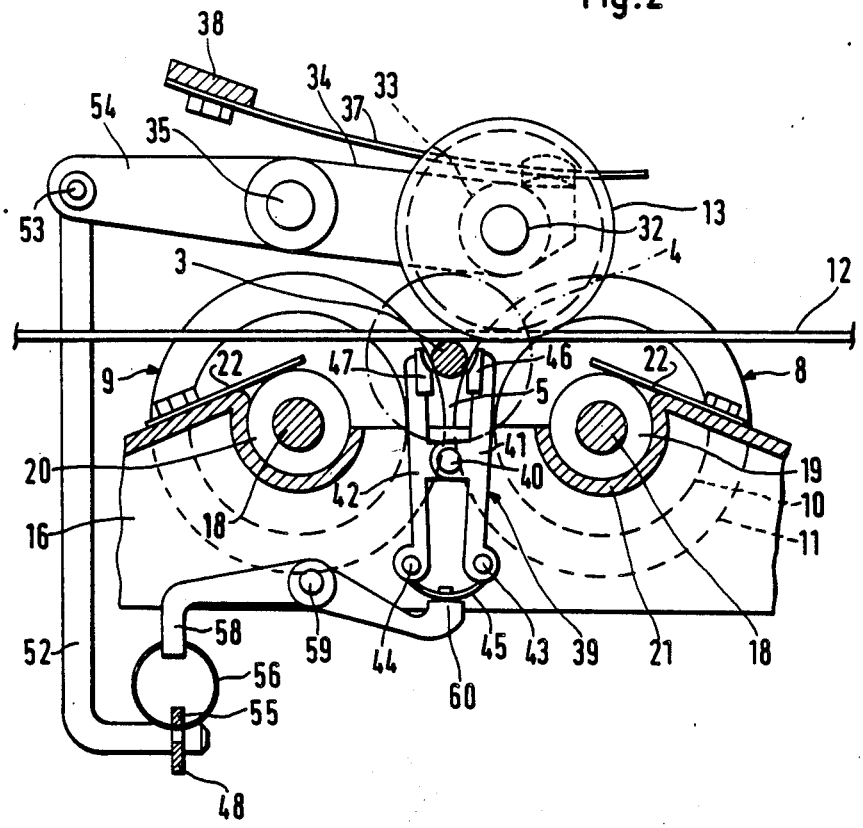
FIG. 2 is a front schematic partially sectional view taken in the direction of the Arrow II of the embodiment in FIG. 1, having certain components not shown for clarity.

As shown in FIG. 2, the actuating element 60 is a two-armed lever that can be pivoted around a shaft 59 extending in parallel to the rotor shaft 3. The shaft 59 is also arranged in the bearing block 16 for the bearing housing 19 and 20 of the shafts 18. The second arm 58 of the two-arm lever 60 extends into the area of the actuating lever 48 and is connected with this lever via a pulling element 56. The pulling element 56 is developed as an annular spring that is affixed to the lever arm 58 and hung into a nose 55 of the arm 51 of the actuating lever 48. The above arrangement provides a uniform, connected actuating mechanism for the tension roller 13 and the braking device 39, in which case the braking force with which the brake shoes 46 and 47 clamp the rotor shaft 3 is essentially dependent on the elastic pulling element 56 and the bent leaf spring 45.

The development of the shown embodiment explained above makes it possible for the supporting disk pairs 6, 8 and 7, 9 to be pressed relatively narrowly against one another. The clear distance A required between the pairs 6, 8 and 7, 9 to be pressed relatively narrowly against one another. The clear distance A required between the pairs 6, 8 and 7, 9 of supporting rollers is determined essentially only by the elements that are required for the drive of the rotor shaft 3 of the spinning rotor 1, i.e., by the tangential belt 12 and the tension roller 13. In practice, the required axial width B of the tension roller 13 determines the clear distance A between the supporting disk pairs 6, 8 and 7, 9. The clear distance A is selected in such a way that it corresponds to the axial width B of the tension roller 13 plus a tolerance play or tolerance distance c. Because of the dimensioning required for the tangential belt 12 and the dimensioning of the tension roller 13 that depends on it, a clear distance A is obtained that does not amount to more than 1.8 times the width of the tangential belt 12. In the case of a practical machine with about 100 spinning points per machine side, this corresponds to about 45 mm. By means of the reduction of the clear distance A, it also becomes possible to significantly shorten the rotor shaft 3 of the spinning rotor unit 1. For reasons of stability and especially because of the critical speed, the diameter of the rotor shaft is at least 7.5 mm. In view of the power that is required especially in the case of very high speeds, the diameter of the rotor shaft 3 should not be significantly larger. The width of the plastic coatings 11 of the supporting disks 6, 8, and 7, 9 amounts to between 10 and 20 percent of the diameter of the rotor shaft 3. Since the rotor 2 rotates in a vacuum housing, a certain shaft length must exist between the rotor 2 and the supporting disk pair 6, 8 facing it, by means of which a rear wall of the rotor housing is penetrated and in the area of which a sealing takes place. A certain length is also required at the opposite end of the rotor shaft, in order to support the rotor shaft in the step bearing 14. Taking into account all these conditions, it is possible according to the invention to still limit the maximum length of the rotor shaft 3 to 90 mm.

Especially because of the narrow clear distance A between the supporting disk pairs 6, 8 and 7, 9, it becomes possible to shift the critical speed into a range of very high speeds that is clearly above the operating speed of the spinning rotor 1 which without difficulty can amount to 120,000 revolutions per minute. For reasons of completeness, it should be mentioned that the critical speed which, however, is not dangerous because during the start of the spinning rotor 1 it is passed through very rapidly. On the whole, a bearing and a drive for an open-end spinning rotor 1 is therefore provided which, in connection with the dimensioning of the open-end spinning rotor 1, makes it possible to work with very high operational speeds without having to fear disturbances.

Although the present invention has been described and illustrated in detail, it is to be clearly understood that the same is by way of illustrations and example only, and is not to be taken by way of limitation. The spirit and scope of the present invention are to be limited only by the terms of the appended claims.

What is claimed is:

1. Bearing and driving unit for a spinning rotor of an open-end spinning unit comprising:

a spinning rotor unit having a rotor and a rotor shaft attached to the rotor;

two pairs of supporting disks, forming a wedge-shaped gap within which the rotor shaft is supported;

a tangential belt drivingly engageable with the rotor shaft at the radial side thereof opposite the supporting disks, tension roller means arranged in proximity of the rotor shaft between the pairs of supporting disks for applying loading forces against the tangential belt toward the wedge-shaped gap, said tension roller means having an axial width along the rotor shaft; and braking means for braking the shaft, said braking means being disposed below the tangential belt, said braking means including at least two brake shoe means for essentially radially and horizontally applying braking forces to sides of the rotor shaft;

wherein the supporting disc pairs are spaced an axial distance from one another which is slightly larger than the axial width of the tension roller means such that the system operational spinning speed is substantially higher than the system cirtical speed at which damaging system resonance vibrations would otherwise occur.

2. Bearing and driving unit for a spinning rotor of an open-end spinning unit comprising:

a spinning rotor unit having a rotor and a rotor shaft attached to the rotor;

two pairs of supporting disks, forming a wedge-shaped gap within which the rotor shaft is supported;

a tangential belt drivingly engageable with the rotor shaft at the radial side thereof opposite the supporting disks;

tension roller means arranged in proximity of the rotor shaft between the pairs of supporting disks for applying loading forces against the tangential belt toward the wedge-shaped gap, said tension roller means having an axial width along the rotor shaft; and braking means for braking the shaft, said braking means being disposed below the tangential belt, said braking means having an axial width equal to or less than the axial width of the tension roller means;

wherein the supporting disc pairs are spaced an axial distance from one another which is slightly larger than the axial width of the tension roller means such that the system operational spinning speed is substantially higher than the system critical speed at which damaging system resonance vibrations would otherwise occur.

3. Arrangement according to claim 2, wherein the braking means includes at least two brake shoe means for essentially radially and horizontally applying braking forces to sides of the rotor shaft.

4. Arrangement according to claim 1, including actuating means for permitting movement of the tangential belt out of drivable engagement with the rotor shaft.

5. Arrangement according to claim 4, wherein said actuating means additionally activates the braking means.

6. Arrangement according to claim 5, wherein the braking means includes:

tong arms on which the brake shoe means are disposed, and a pivotal shaft means disposed essentially vertically under and parallel to the rotor shaft for pivotal mounting of the tong arms.

7. Arrangement according to claim 6, wherein the brake shoe means are equipped with cup-shaped braking surfaces adapted to the rotor shaft.

8. Arrangement according to claim 6, wherein each tong arm includes a double-armed lever having a first arm disposed above the pivotal shaft and a second arm disposed below the pivotal shaft.

9. Arrangement according to claim 8, wherein the braking means further includes a spring means connecting the second arms of each double-armed lever for pulling the second arms toward one another and thereby pulling the first arms apart, said first arms having the braking shoes means disposed thereon.

10. Arrangement according to claim 9, wherein the spring means include at least one bent leaf spring having an end attached to the second arm of each doubled-armed lever.

11. Arrangement according to claim 10, wherein the braking means includes a braking element disposed on the convex side of the leaf spring, the braking element being adjustable toward the pivotal shaft.

12. Arrangement according to claim 11, wherein the actuating means includes a lifting element for lifting the tension roller out of drivable engagement with the tangential belt.

13. Arrangement according to claim 12, wherein the actuating means includes an elastic connect means for connecting the braking element to the lifting element.

14. Arrangement according to claim 13, wherein the axial distance between the supporting disk pairs is not more than 1.8 times the width of the tangential belt.

15. Arrangement aocording to claim 13, wherein the axial distance between the pairs of supporting disk is not more than 45 mm.

16. Arrangement according to claim 13, wherein the rotor shaft has a length of not more than 90 mm and a diameter of at least 7.5 mm, and the rotor has a weight of not more than 0.157367 pound weight.

17. Arrangement according to claim 1, wherein the axial distance between the supporting disk pairs is not more than 1.8 times the width of the tangential belt.

18. Arrangement according to claim 1, wherein the axial distance between the pairs of supporting disk is not more than 45 mm.

19. Arrangement according to claim 1, wherein the rotor shaft has a length of not more than 90 mm and a diameter of at least 7.5 mm, and the rotor has a weight of not more than 0.157367 pound weight.

* * * * *